US008960374B2

(12) United States Patent
Nakagawa

(10) Patent No.: US 8,960,374 B2
(45) Date of Patent: Feb. 24, 2015

(54) ELEVATOR GROUP CONTROL METHOD AND DEVICE FOR PERFORMING CONTROL BASED ON A WAITING TIME EXPECTATION VALUE OF ALL PASSENGERS ON ALL FLOORS

(75) Inventor: Masami Nakagawa, Hikone (JP)

(73) Assignee: Fujitec Co., Ltd., Hikone-shi (JP)

( * ) Notice: Subject to any disclaimer, the term of this patent is extended or adjusted under 35 U.S.C. 154(b) by 787 days.

(21) Appl. No.: 13/142,183

(22) PCT Filed: Dec. 25, 2009

(86) PCT No.: PCT/JP2009/071544

§ 371 (c)(1),
(2), (4) Date: Jun. 24, 2011

(87) PCT Pub. No.: WO2010/074201

PCT Pub. Date: Jul. 1, 2010

(65) Prior Publication Data

US 2011/0284329 A1 Nov. 24, 2011

(30) Foreign Application Priority Data

Dec. 25, 2008 (JP) ..... 2008-329651

(51) Int. Cl.
*B66B 1/18* (2006.01)
*B66B 1/24* (2006.01)

(52) U.S. Cl.
CPC ..... *B66B 1/2458* (2013.01); *B66B 2201/102* (2013.01); *B66B 2201/211* (2013.01);
(Continued)

(58) Field of Classification Search
CPC ..... B66B 2201/10; B66B 2201/102; B66B 2201/20; B66B 2201/21; B66B 2201/211; B66B 2201/235; B66B 2201/216; B66B 2201/233; B66B 2201/243; B66B 2201/402; B66B 1/2458
USPC ..... 187/247, 380–388, 391–393
See application file for complete search history.

(56) References Cited

U.S. PATENT DOCUMENTS 4,030,571 A 6/1977 Kaneko et al.
4,947,965 A * 8/1990 Kuzunuki et al. ..... 187/387
(Continued)

FOREIGN PATENT DOCUMENTS

JP 6-2553 B2 1/1994
JP 6-62259 B2 8/1994
(Continued)

OTHER PUBLICATIONS

Extended European Search Report dated Jul. 5, 2013, issued in corresponding European Patent Application No. 09834997.0 (6 pages).
(Continued)

*Primary Examiner* — Anthony Salata
(74) *Attorney, Agent, or Firm* — Westerman, Hattori, Daniels & Adrian, LLP

(57) ABSTRACT

Provided are a group control method and a group control device capable of efficiently controlling the operation of elevators in diversified traffic situations and under a variety of specification conditions required for a group management system. A plurality of elevators are placed in service for a plurality of floors, an evaluation index for a newly made hall call is calculated, and the best suited car is selected and assigned to the hall call based on the evaluation index in the group control method of elevators. A waiting time expectation value of all passengers on all floors for each direction, either that have already occurred or that are expected to occur within a predetermined time period, is taken as the evaluation index, the waiting time expectation value being the expectation value for the sum or the average of waiting time.

9 Claims, 13 Drawing Sheets

(52) U.S. Cl.
CPC ..... *B66B2201/216* (2013.01); *B66B 2201/233* (2013.01); *B66B 2201/235* (2013.01); *B66B 2201/243* (2013.01); *B66B 2201/402* (2013.01)
USPC ..... 187/382; 187/247

(56) References Cited

U.S. PATENT DOCUMENTS

| | | | | |
|---|---|---|---|---|
| 4,982,817 | A * | 1/1991 | Tsuji | 187/387 |
| 4,989,694 | A * | 2/1991 | Ueshima et al. | 187/380 |
| 4,993,518 | A * | 2/1991 | van Straaten et al. | 187/387 |
| 5,020,642 | A * | 6/1991 | Tsuji | 187/382 |
| 5,331,121 | A * | 7/1994 | Tsuji | 187/388 |
| 5,480,005 | A * | 1/1996 | Bittar | 187/383 |
| 5,529,147 | A * | 6/1996 | Tsuji | 187/382 |
| 5,767,461 | A * | 6/1998 | Nakagawa et al. | 187/382 |
| 6,241,050 | B1 | 6/2001 | Hikita et al. | |
| 6,315,082 | B2 * | 11/2001 | Hikita | 187/382 |
| 6,345,697 | B1 * | 2/2002 | Siikonen | 187/382 |
| 6,360,849 | B1 * | 3/2002 | Hikita | 187/381 |
| 6,619,437 | B2 * | 9/2003 | Hikita | 187/383 |
| 7,426,982 | B2 * | 9/2008 | Yoshikawa et al. | 187/382 |
| 7,484,597 | B2 * | 2/2009 | Nikovski et al. | 187/382 |
| 7,487,860 | B2 * | 2/2009 | Hikita et al. | 187/249 |
| 7,562,746 | B2 * | 7/2009 | Yoshikawa et al. | 187/382 |
| 7,568,556 | B2 * | 8/2009 | Hikita | 187/382 |
| 7,740,111 | B2 * | 6/2010 | Yoshikawa et al. | 187/382 |
| 8,196,711 | B2 * | 6/2012 | Tokura | 187/382 |
| 8,567,569 | B2 * | 10/2013 | Suzuki et al. | 187/382 |
| 2010/0230213 | A1 | 9/2010 | Kobori et al. | |

FOREIGN PATENT DOCUMENTS

| | | | |
|---|---|---|---|
| JP | 08-225256 | A | 9/1996 |
| JP | 3037215 | U | 5/1997 |
| JP | 2006-124075 | A | 5/2006 |
| JP | 2006-298577 | A | 11/2006 |
| JP | 2007-015862 | A | 1/2007 |
| WO | 99/50164 | A1 | 10/1999 |
| WO | 99-50164 | A1 | 10/1999 |
| WO | 2004/113216 | A2 | 12/2004 |
| WO | 2008/001508 | A1 | 1/2008 |

OTHER PUBLICATIONS

International Search Report for PCT/JP2009/071544, mailing date of Mar. 9, 2010.

Japanese Office Action mailed May 7, 2013, issued in corresponding Japanese Patent Application No. 2008-329651; w/partial English translation (4 pages).

* cited by examiner

| | FIRST LOOP | | SECOND LOOP | | THIRD LOOP | |
|---|---|---|---|---|---|---|
| | Up | Down | Up | Down | Up | Down |
| 11F | | 50 | | 102 | | |
| 10F | 40 | 40 | 92 | 92 | | |
| 9F | 38 | 50 | 90 | 102 | 102 | |
| 8F | 36 | 52 | 88 | 104 | 104 | |
| 7F | 26 | 54 | 86 | 106 | 106 | |
| 6F | 24 | 56 | 84 | 108 | 108 | |
| 5F | 22 | 58 | 82 | 110 | 110 | |
| 4F | 12 | 60 | 80 | 112 | 112 | |
| 3F | 10 | 62 | 78 | 114 | 114 | |
| 2F | 0 | 64 | 76 | 116 | 116 | |
| 1F | 66 | | 118 | | | |

ELEVATOR GROUP CONTROL METHOD AND DEVICE FOR PERFORMING CONTROL BASED ON A WAITING TIME EXPECTATION VALUE OF ALL PASSENGERS ON ALL FLOORS

FIELD OF THE INVENTION

The present invention relates to elevator group control methods and control devices, and aims, in particular, to provide a group control method and a group control device capable of efficiently control the operation of the elevators in diversified traffic situations and under a variety of specific conditions required for a group management system.

BACKGROUND OF THE INVENTION

In general, the objective of operation control of conventional group management systems is to reduce the average waiting time of passengers in elevators by efficiently controlling the operation of a plurality of elevators within a building.

Therefore, what the group management system must truly evaluate in its control operation is that the waiting time of passengers, including prospective passengers, and the significance of waiting time of individual passengers should be basically considered to be equivalent. However, a group management system has difficulty in directly figuring out the waiting time of individual passengers. Accordingly, the control operation is conventionally performed by evaluating the waiting time of a hall call as an alternative, that is, evaluating a time period as waiting time from a hall call is registered until an elevator arrives in response to the call.

Further, when evaluating, a focus of the evaluation is placed on the waiting time of a newly registered hall call as a target of assignment, and the waiting time of individual hall calls is not treated equivalently. In addition, as an assignment of a hall call affects, not only a call that has already been made but also a hall call that is possibly made in the near future, it is essential that the evaluation includes any hall call that may be made in the future. However, even if a hall call that is possibly made in the future is evaluated, an evaluation value for the call is usually treated only as a correction term (e.g., Patent Publication 1).

On the other hand, the conventional group management system is typically based on an "immediate assignment method" which determines a car to respond instantly upon registration of a hall call, and an "immediate prediction method" of which announces an assigned car instantly at an elevator hall. In a group management system employing the "immediate prediction method", as any change in an assignment of a hall call that has been made may cause confusion among passengers waiting for an elevator, it is desirable not to change the assignment if circumstances allow. Accordingly, the assignment change is limited to a case satisfying specific conditions, such as changing an assignment of a potentially long waiting hall call to a different car (e.g., Patent Publication 2).

Further, the conventional group management system is provided with controlling means for moving a car to a random floor by assigning a pseudo call (virtual call) to the car. However, such means are used only under limited traffic situations such as distributed waiting during down peak and reference floor recalling when people arrive before working hours (e.g., Patent Publication 3).

Moreover, development of the conventional group management systems has been promoted in the policy of reducing waiting time of the hall call as much as possible with the application of artificial intelligence technologies such as "fuzzy" and "neuro" (e.g., Patent Publication 4).

CITATION LIST

Patent Publication

Patent Publication 1: Japanese Examined Patent Publication No. H06-62259

Patent Publication 2: Japanese Unexamined Patent Publication No. 2006-124075

Patent Publication 3: Japanese Examined Patent Publication No. H06-2553

Patent Publication 4: Japanese Unexamined Patent Publication No. H08-225256

SUMMARY OF THE INVENTION

Problems to be Solved by the Invention

As described above, what a group management system must truly evaluate in its control operation is the waiting time of passengers including prospective passengers. However, when the control operation is performed by evaluating the waiting time of a hall call as an alternative as described in Patent Publication 1, only the waiting time of a person who first registers a hall call is evaluated when a plurality of waiting passengers are present on one floor, and it is not possible to appropriately evaluate the waiting time of a plurality of passengers waiting after this hall call. In addition, unless considering all, not just a part, of the hall calls (waiting passengers) that are possibly made in the future, the waiting time of passengers as a result of control operation of a group management system cannot be appropriately evaluated. Consequently, in a traffic situation in which waiting passengers are concentrated on a plurality of unspecified floors, it is a difficult challenge to reduce long waiting periods by adequately evaluating the waiting time and controlling the operation of elevators. For example, if it is presumed that passengers are concentrated only on a specific floor such as in the case when people arrive before working hours in an office building, it is relatively easy to prepare a control method suitable for such a traffic situation. However, it is difficult to flexibly control the operation of elevators by appropriately evaluating waiting time in complicated and diversified traffic situations such as a case where the traffic is concentrated on a plurality of unspecified floors.

Further, according to Patent Publication 2, an assignment is changed only when a specific event such as a long waiting occurs. However, the "immediate prediction method" on which a typical group management system is based may not be necessary in the first place depending on the country or region the system is employed or on the clients' view. In addition, immediate prediction is often not applicable in the case in which a number of elevators in a group management system is small. In such a case, while an assignment of a hall call can normally be changed freely as long as the waiting time of passengers can be reduced if only a little, as different evaluative criteria are used in an assignment of a hall call and an assignment change of a hall call, an assignment change of a hall call is not exactly used to the best effect in the reduction of waiting time of passengers.

Similarly, while Patent Publication 3 is provided with the controlling means for assigning a pseudo call (virtual call) to an empty car (car stopping without a traveling direction) and moving the car to any floor, such means are still used only under limited traffic situations such as distributed waiting during down peak and reference floor recalling when people arrive before working hours. Accordingly, although there is the possibility that waiting time can be reduced by assigning a pseudo call in any traffic situation, as different evaluative criteria are used in an assignment of a hall call and an assignment of a pseudo call, an assignment of pseudo call is not exactly used to the full extent in the reduction of waiting time at an elevator hall.

Moreover, an acceptable degree of repetition of an assignment change and an assignment of a pseudo call varies depending on the group management specification, the elevator specification, the user interface of an elevator hall, the use of the building, clients' needs, or traffic situation, and it is difficult to perform group control to reduce waiting time of passengers while conducting an assignment change or an assignment of a pseudo call at an adequate degree of repetition according to various requirements and specific conditions.

Furthermore, when it is intended to reduce the waiting time of a hall call as much as possible with applying artificial intelligence technologies as described in Patent Publication 4, while a highly advanced control can provide some effects, this also increases complexity and size of the system, making the system a black box. Therefore, it is difficult to respond to tasks such as adding a new control function within a limited development period, in addition to the problems as described above, and it is extremely difficult to analyze, explain, and adjust a problem in the control even if it is pointed out.

Means of Solving the Problems

The present invention has been made in order to address the various problems described above, and to provide an elevator group control method, including: placing a plurality of elevators in service for a plurality of floors; calculating an evaluation index for a newly made hall call; and selecting and assigning the best suited car to the hall call based on the evaluation index, wherein a waiting time expectation value of all passengers on all floors for each direction either that have already occurred or that is expected to occur within a predetermined time period is taken as the evaluation index, the waiting time expectation value being the expected value the sum or the average of the waiting time.

Further, according to the present invention, other than the assignment of the new hall call is performed using the waiting time expectation value as the evaluation index, an assignment change of a hall call or a pseudo call assignment to an empty car is performed based on the same evaluation index every predetermined time period or at the same time with the assignment of the new hall call.

Moreover, according to the present invention, the waiting time expectation value is calculated by using an estimated value of the passenger arrival rate on each floor and for each direction, an estimated value of hall call occurrence rate for an entire group, and an estimated time of arrival for each car, for each floor and in each direction.

Effects of Invention

According to the present invention, employing a method of stochastically evaluating the waiting time of passengers, instead of the waiting time of a hall call as in a conventional example, allows appropriate evaluation of a bias of the passenger arrival rate on each floor and the waiting time of prospective passengers, and it is possible to reduce the waiting time of passengers as originally desired in complicated and diversified traffic situations.

Further, according to the present invention, as the evaluation of the waiting time of a hall call is not necessary, it is possible to evaluate a situation as needed even when there is no new hall call. Therefore, the same evaluation index (waiting time expectation value of the all passengers) can be applied in a versatile manner for controlling means other than means for assigning a hall call, that is, an assignment change of a hall call or an assignment of a pseudo call to an empty car that is stopping without a traveling direction, and thus it is possible to facilitate optimization of the control as a whole.

Moreover, according to the present invention, when the group management system does not employ the immediate prediction, by constantly and effectively utilizing an assignment change of a hall call without restricting to a limited traffic situation, it is possible to reduce the waiting time of passengers.

Furthermore, according to the present invention, by constantly and effectively utilizing a pseudo call assignment without restricting to a limited traffic situation, that is, by moving an empty car that is stopping without any traveling direction to an appropriate position as needed, it is possible to reduce the waiting time of passengers.

Further, according to the present invention, a degree of repetition of an assignment change or a pseudo call assignment can be adjusted according to diverse needs and specific conditions that vary depending on individual buildings, and it is possible to reduce the waiting time of passengers under adjusted conditions.

Moreover, according to the present invention, a group control method based on a unified evaluation index of the waiting time of passengers can be realized, and consequently it is possible to simplify the control structure as compared to the group control to which conventional artificial intelligence is applied. Therefore, it is possible to facilitate addition of a new control function, and to easily analyze, explain, and adjust a problem in the control when it is pointed out.

DETAILED DESCRIPTION OF PREFERRED EMBODIMENTS

First Embodiment

In general, the car position in a group control cannot be judged only by a floor level, the traveling direction of the car should be included in the judgment. Therefore, in the description hereinafter, the term "station position" is used as a concept for expressing the stop position of a car including both floor and direction to simplify explanation.

Now, one embodiment of the present invention will be described with reference to FIG. 1 through FIG. 16.

Figure 1:
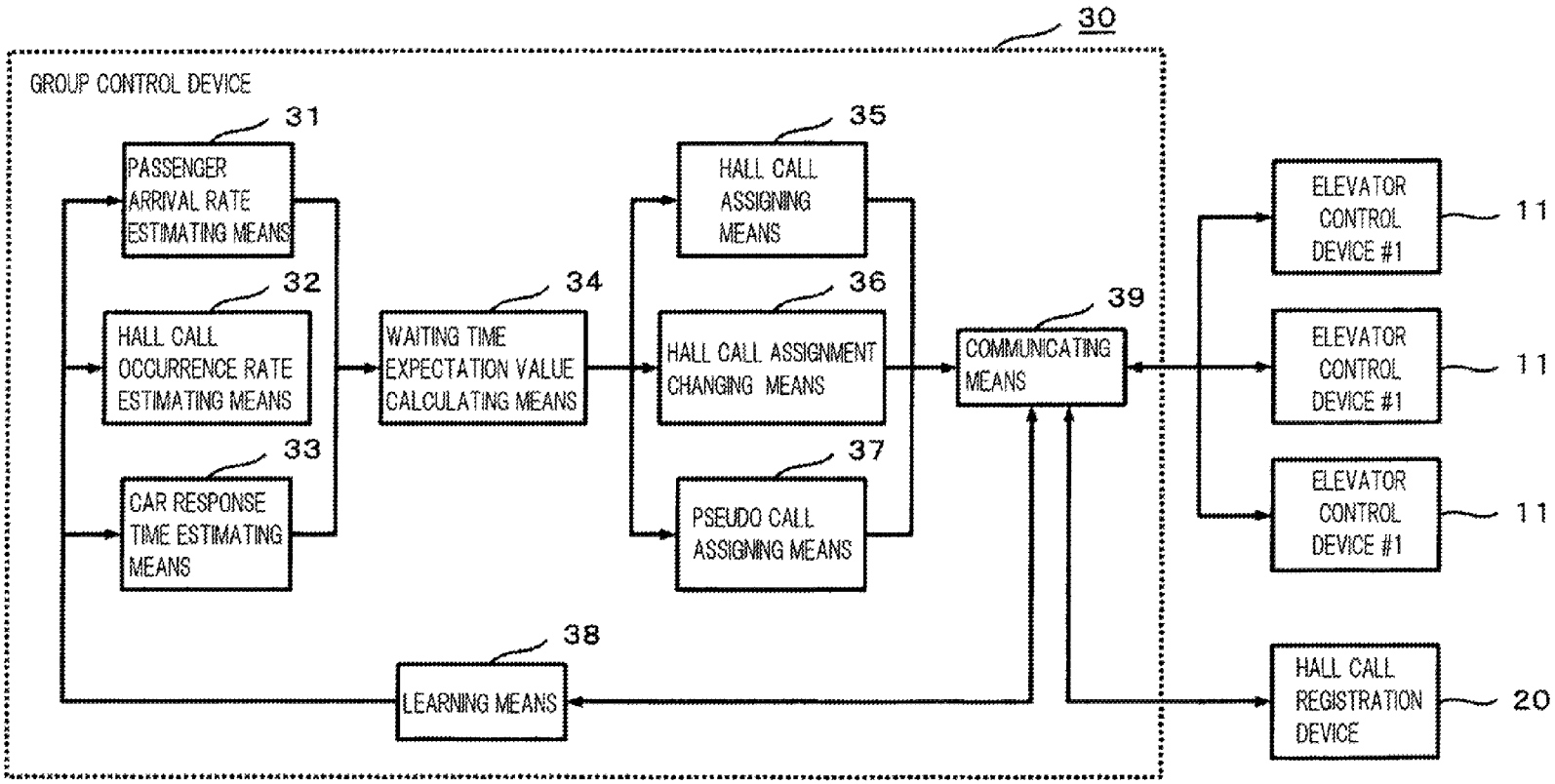
FIG. 1 is a diagram showing an entire configuration of a group management system of elevators according to a first embodiment of the present invention.

FIG. 1 is a diagram showing an entire configuration of a group management system of elevators according to a first embodiment of the present invention. Here, the description is given taking an example in which three elevator cars including a first car to a third car are controlled as a group. However, it should be appreciated that the number of the elevators is not limited to three.

Referring to FIG. 1, reference number 11 represents an elevator control device configured to perform elevator control operation of the first car, reference numbers 12 and 13 similarly represent elevator control devices configured to perform elevator control operation respectively of the second car and the third car, a reference number 20 represents a hall call registration device that is common to all elevators and configured to register a hall call, and a reference number 30 represents a group control device configured to control the operation of the elevators as a group while communicating with the elevator control devices 11-13.

Reference number 31 represents passenger arrival rate estimating means configured to estimate a passenger arrival rate at a station position. The passenger arrival rate estimating means estimates the passenger arrival rate using a conventional method such as, for example, stochastic estimation of the passenger arrival rate based on learned data relating to a time period during which no hall call is made by presuming the arrival of a passenger who uses an elevator to be Poisson arrival. It is also possible to correct the passenger arrival rate according to variations in a number of car calls and a live load of a car.

Reference number 32 represents hall call occurrence rate estimating means configured to estimate the rate of occurrence of hall calls in an entire group. This also can be easily obtained using a conventional method such as division of the number of hall calls occurring per a predetermined time, this time period is based on a short-term learning or a long-term learning by the predetermined time.

Reference number 33 represents car arrival time estimating means configured to estimate time at which each car can arrive at each station position, and it is possible to use various methods of conventional hall call waiting time estimation as the method to estimate the time of arrival. However, while estimation of waiting time for a single entire loop of car is sufficient in the conventional hall call waiting time estimation, as the present invention is also required to estimate waiting time of prospective passengers, it is necessary to estimate waiting time for a single entire loop and a half considering a farthest car call that is set off from an assigned hall call on a back side as shown in FIG. 2, and to estimate for two entire loops and a half at maximum, considering the necessity of estimating waiting time of passengers that may occur after responding to all the calls that can be assumed.

Figures 2, 3:
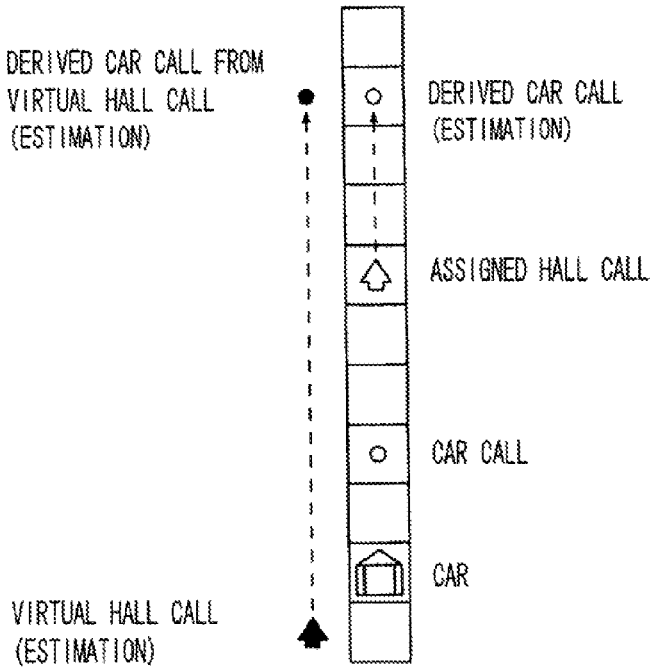
FIG. 2 is a diagram showing a relation between the position of a car and a call for explaining the estimated arrival time of the car.
FIG. 3 is a table illustrating one example of a table for estimated time of arrival according to the present invention.

One example of a table for estimated time of arrival produced by the car arrival time estimating means is shown in FIG. 3. Here, while calculation is made by assuming that time required for a car to travel a single floor is 2 seconds and that the time required for a car to make a single stop is 10 seconds to simplify an explanation, traveling time and such are calculated based on learned data of group management in practice.

Referring back to FIG. 1, a reference number 34 represents waiting time expectation value calculating means configured to stochastically calculate, as a general evaluation index, an expectation value of a sum or an average of the waiting time of all the passengers (including passengers that have already appeared) estimated to appear at all of the station positions within predetermined time (hereinafter, the expectation value of the sum or the average of waiting time is simply referred to as a waiting time expectation value). A concept and a method of calculation of the waiting time expectation value of all passengers will be described later.

A reference number 35 represents hall call assigning means configured to evaluate a newly registered hall call taking the waiting time expectation value as an evaluation index, or holistically in conjunction with other evaluation indices, and to assign the call to the best suited car. The hall call assigning means performs an assignment process every time a new hall call is made.

A reference number 36 represents hall call assignment changing means configured to change an assignment of a hall call that has been assigned based on the waiting time expectation value. The hall call assignment changing means calculates, every predetermined time, the waiting time expectation value assuming that the assignment is changed, compares the calculated waiting time expectation value with the waiting time expectation value before the assignment change is made, and performs the assignment change of the hall call if a difference between the two values satisfies a predetermined condition.

A reference number 37 represents pseudo call assigning means configured to assign a pseudo call to an empty car based on the waiting time expectation value. The pseudo call assigning means calculates, every predetermined time, the waiting time expectation value assuming that a pseudo call is assigned, compares the calculated waiting time expectation value with the waiting time expectation value before the assignment of a pseudo call is made, and assigns a pseudo call to the empty car if a difference between the two values satisfies a predetermined condition.

A reference number 38 represents learning means configured to perform statistical processing of data received from the elevator control devices 11-13 and the hall call registration device 20 and accumulates the data. The learning means is configured by, similarly to those used in conventional group control, such as short-term learning means for learning about current traffic situation, and long-term learning means for learning about traffic situation in each time period on weekday, weekend, or the same day.

A reference number 39 represents communicating means configured to communicate with each of the elevator control devices 11-13.

Next, a procedure of an elevator group control method according to the present invention of the above configuration is described with reference to flowcharts in FIG. 4 through FIG. 16.

Figure 4:
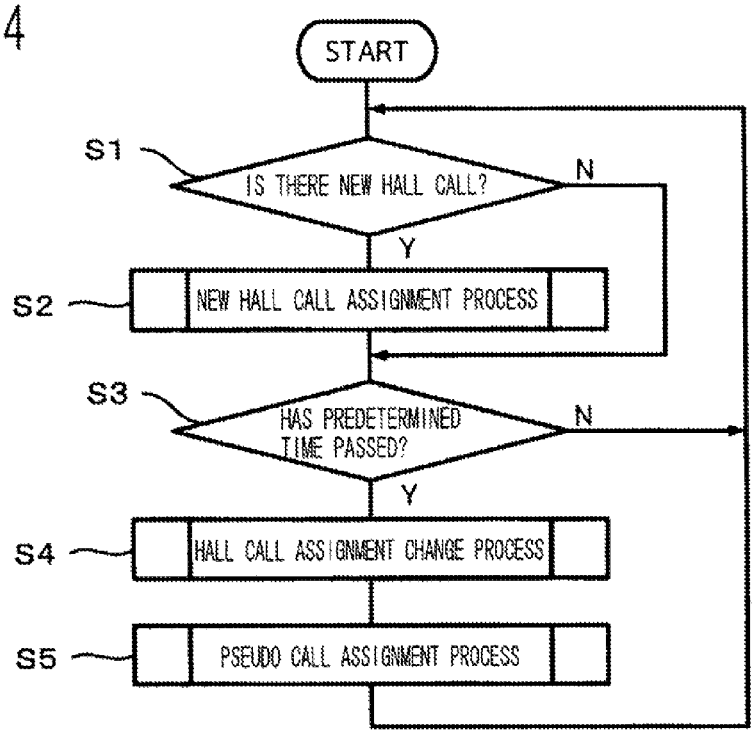
FIG. 4 is a main flowchart showing an entire procedure according to the first embodiment of the present invention.

FIG. 4 is the main flowchart of the entire procedure, showing that the assignment process is performed every time when a new hall call is made, and a hall call assignment change process and a pseudo call process are performed every predetermined time. This procedure is constantly and repeatedly performed.

First, in Step S1, it is determined whether or not a new hall call is present, and if present, awaiting time expectation value of all passengers at all station positions is calculated in Step S2, and the hall call is assigned to the best suited car based on a result of the calculation. Further, separately from the assignment of the new hall call, every time a predetermined time passes (Step S3), the current waiting time expectation value of all the passengers and the waiting time expectation value assuming that an assignment change is performed, are compared in Step S4, and the assignment change is performed if a difference between the two values satisfies a predetermined condition. Similarly, the current waiting time expectation value and the waiting time expectation value assuming that a pseudo call is assigned to an empty car are compared in Step S5, and the assignment process of a pseudo call is performed if a difference between the two values satisfies a predetermined condition. Details of these processes will be described later. As described above, according to the first embodiment, the waiting time expectation value of all the passengers is calculated when a new hall call is made and every predetermined time, the assignment change of a hall call and the assignment of a pseudo call to an empty car, in addition to the assignment of a new hall call are performed based on the same evaluation index every predetermined time so that the value is as small as possible, that is, so that the waiting time of all the passengers is reduced.

Here, before describing the details of the processes, an idea of the waiting time expectation value of all the passengers at all of the station positions as a general evaluation index and how to calculate this value according to the present invention are described.

First, when evaluating the waiting time of all the passengers, how to evaluate arrival time of an empty car (car stopping without a traveling direction) must be considered. Unless the arrival time of an empty car can be appropriately evaluated, it is not possible to obtain a general evaluation index that can be applied to every traffic situation. In particular, as the pseudo call assignment control is in principle performed for an empty car, it is important to appropriately evaluate the arrival time of an empty car.

However, there are many uncertain elements regarding a time point and a direction at and in which an empty car starts traveling, and it is not possible to estimate the arrival time of an empty car to each station position in the same manner as a traveling car. For example, when a hall call is made at one station position in the future, the empty car may have responded to a different hall call and may not be present at an original position. Therefore, based on a hall call occurrence rate and the number of cars in an entire group, a probability P(t) that an empty car is present at an original position in a standby state is expressed as an exponential function of time t in equation 1 listed below, and it is assumed that the empty car can arrive at any station position in response to a call from this station position if the car is in the standby state, and that the empty car is removed from evaluation targets when the car is not in standby state.

$$P(t)=\exp(-\alpha t) \quad \text{[Equation 1]}$$

$\alpha$: A hall call occurrence rate per car

In this manner, by expressing the standby probability of an empty car in an exponential function, and using this in the calculation of the waiting time expectation value, as will be described later, it is possible to stochastically evaluate an influence of the presence of an empty car to the waiting time of prospective passengers although in a simplified manner.

Figure 5:
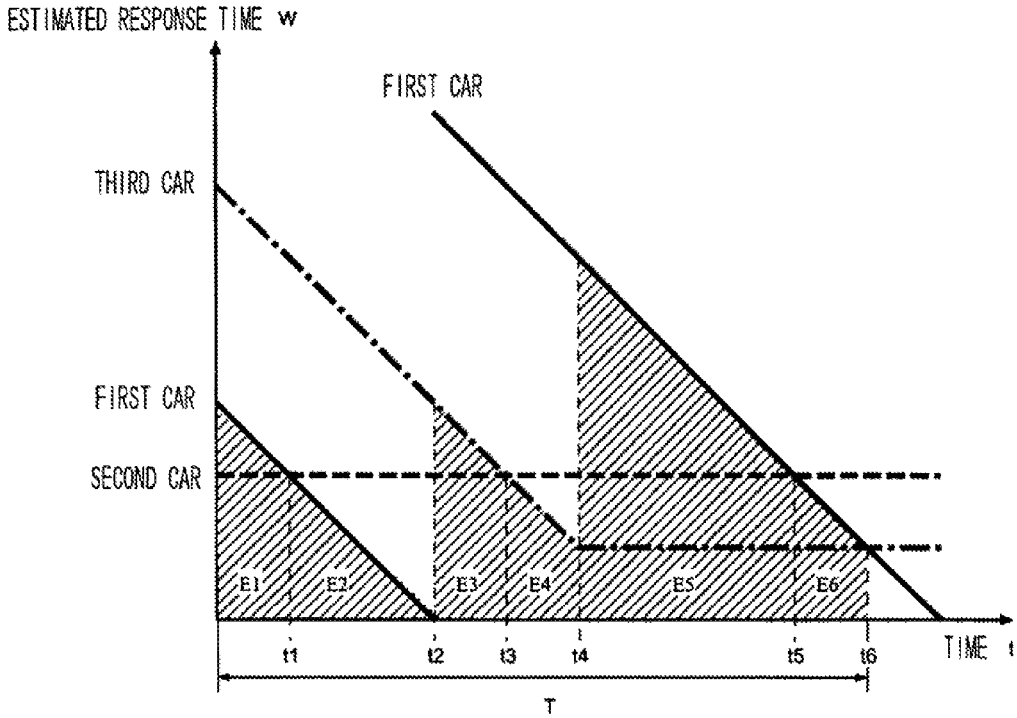
FIG. 5 is a chart showing a variation in the estimated time of arrival of each car at one station position.

Next, the calculation of "the waiting time expectation value of all the passengers expected to occur within predetermined time T" at one station position is described by schematizing as shown in FIG. 5.

FIG. 5 is a graphic chart showing variation in estimated time of arrival of each car at one station position, in which a horizontal axis represents time and a vertical axis represents the estimated time of arrival. Here, the chart shows that the first car is always traveling within the time T, and passes once by a station position as a target. The chart also shows that the second car currently stops as an empty car, and that the third car is currently traveling but stops at time $t_4$ and becomes an empty car.

In FIG. 5, the waiting time expectation value of all the passengers is obtained by the integration of the shaded area and multiplication of a passenger arrival rate $\lambda$. However, when there is an empty car present closer than a traveling car, the expectation value of the waiting time is calculated assuming that this empty car responds at the probability P(t) expressed by the equation 1.

Regions in the shaded area are divided by time that satisfies conditions as listed below.

(a) Time at which estimated time of arrival of the traveling car becomes equal to estimated time of arrival of the empty car.

(b) Time at which the traveling car becomes an empty car in a stopped state.

(c) Time at which the traveling car arrives at the target station position.

Figure 6:
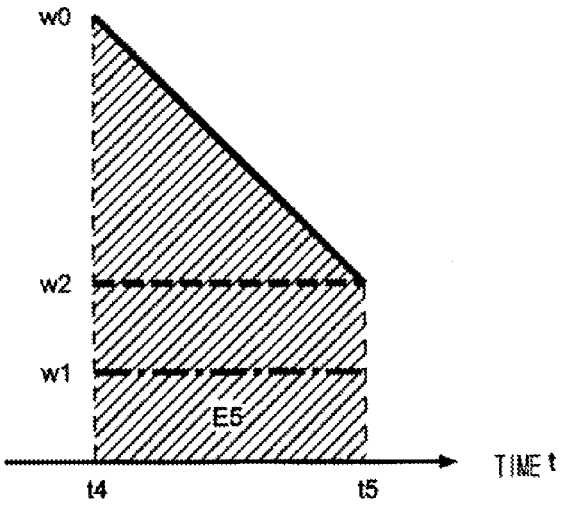
FIG. 6 is a chart showing a part of FIG. 5 by dividing the shaded region.

As the region divided in this manner shows a simple shape as shown in FIG. 6, it is possible to perform integral calculation easily, and to obtain the waiting time expectation value of all the passengers that occur in a time period represented by the divided region.

For example, the waiting time expectation value of all the passengers in a region $E_5$ shown in FIG. 5 can be obtained by equation 2 listed below.

$$E_5=\int_{t_4}^{t_5}\lambda_s(w_1P(t)+w_2P(t)(1-P(t))+(w_0-(t-t_4))(1-P(t))^2)dt \quad \text{[Equation 2]}$$

$\lambda_s$: A passenger arrival rate at the station position s

Similarly, where a number of empty cars that can influence the waiting time of passengers at a station position as a general target is m, a waiting time expectation value $E_Z$ of all the passengers in time periods $t_a$-$t_b$ can be obtained by equation 3 listed below.

[Equation 3]

$$E_z = \int_{t_a}^{t_b} \lambda \left( \sum_{k=1}^{m} (w_k P(t)(1 - P(t))^{k-1}) + (w_0 - (t - t_a)) (1 - P(t))^m \right) dt \quad \text{[Equation 3]}$$

$w_0$: Estimated time of arrival at time $t_a$ of a car that arrives at a target station position in the shortest time out of all traveling cars $w_1$, $w_2$, . . . : Estimated time of arrival of cars whose estimated time of arrival at target station position is shorter than $w_0$ out of empty cars, where $w_1$, $w_2$, . . . are in ascending order of estimated time of arrival.

In this manner, by summing up the waiting time expectation values of the passengers obtained for the respective regions, a waiting time expectation value Es of all the passengers that appear at a station position s within a predetermined time T is obtained by equation 4 listed below.

$$E_s = \sum_{k=1}^{n} E_z \quad \text{[Equation 4]}$$

n: A number of divided regions

It should be noted that there must be a single passenger at hall call registration if a hall call has already been made at this station position, and it is possible to ignore the presence of an empty car until a car assigned to this hall call arrives. Therefore, the waiting time expectation value of the passengers in this case can be obtained by equation 5 listed below.

$$E_z = hcwt + \lambda \cdot \frac{hcwt^2}{2} \quad \text{[Equation 5]}$$

Then, the waiting time expectation value ET of all the passengers that have appeared or may appear within the predetermined time T at all the station positions can be finally obtained by equation 6 listed below.

$$E_T = \sum_{s \in S} E_s \quad \text{[Equation 6]}$$

S: A class representing all station positions $E_T$ is "the waiting time expectation value of all the passengers at all the station positions" used as a general evaluation index in the group control method according to the present invention.

Based on what has been described above, the steps for calculating the waiting time expectation value of all the passengers at all the station positions, and the procedure for assigning a new hall call based on the result of the calculation are described with reference to flowcharts in FIG. 7 through FIG. 10.

Figure 7:
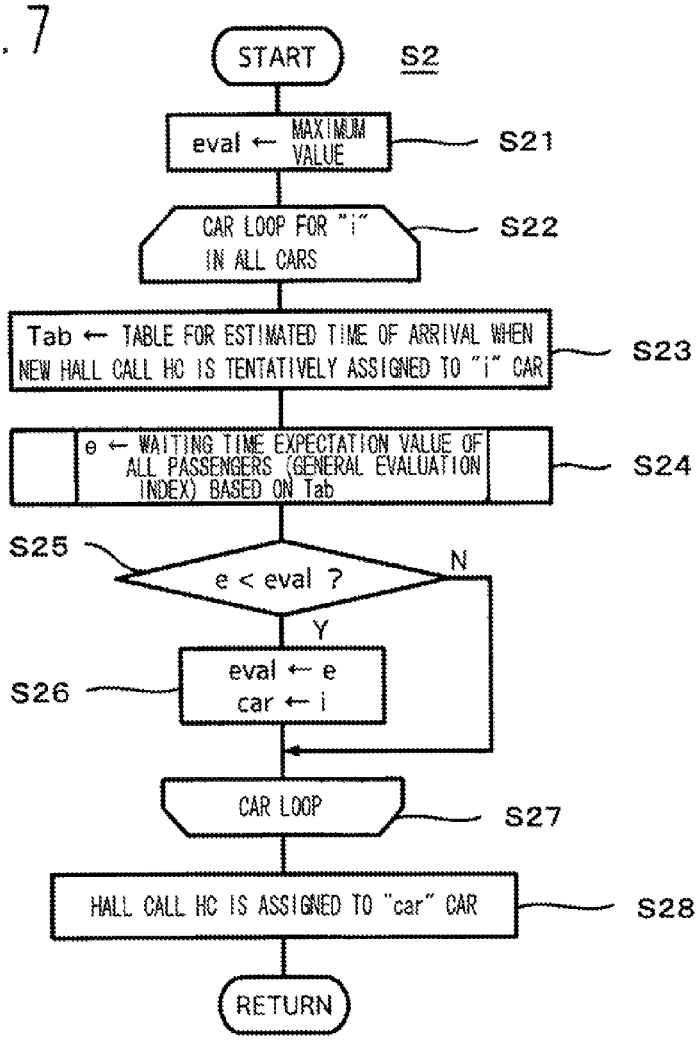
FIG. 7 is a flowchart explaining a specific procedure of the new hall call assignment process in Step S2 in FIG. 4.

FIG. 7 is a flowchart explaining a specific procedure in Step S2 in FIG. 4, showing the steps for calculating the waiting time expectation value of all the passengers at all the station positions assuming that a new hall call is tentatively assigned to each car, and assigning the new hall call to a car whose waiting time expectation value is the smallest.

First, in Step S21, the initial value of a variable eval representing the waiting time expectation value is set to be the maximum value, and based on Step S22 and Step S27, the process between these steps is repeated for all of the cars.

In Step S23, a table for estimated time of arrival for a case in which a new hall call HC is tentatively assigned to an "i" car is generated for each car as shown in FIG. 3. Then, in Step S24, the waiting time expectation value of all the passengers at all the station positions, assuming that the hall call is tentatively assigned to the "i" car, is calculated based on the generated table for estimated time of arrival (detailed steps will be described later), and stored as variable e.

In Step S25, the variable e is compared with the variable eval. If e<eval, a waiting time expectation value e at this time is substituted for the variable eval, and a car number "i" is substituted for "car" in Step S26. Similarly, Step S23 through Step S26 are repeated for all of the cars, and the smallest value out of the waiting time expectation values of all the passengers at all the station positions assuming that the new hall call is tentatively assigned to the respective cars is stored as eval, and the car that is tentatively assigned at this time is stored as "car". Then, in Step S28, the new hall call HC is actually assigned to the "car" car whose waiting time expectation value is the smallest.

Figure 8:
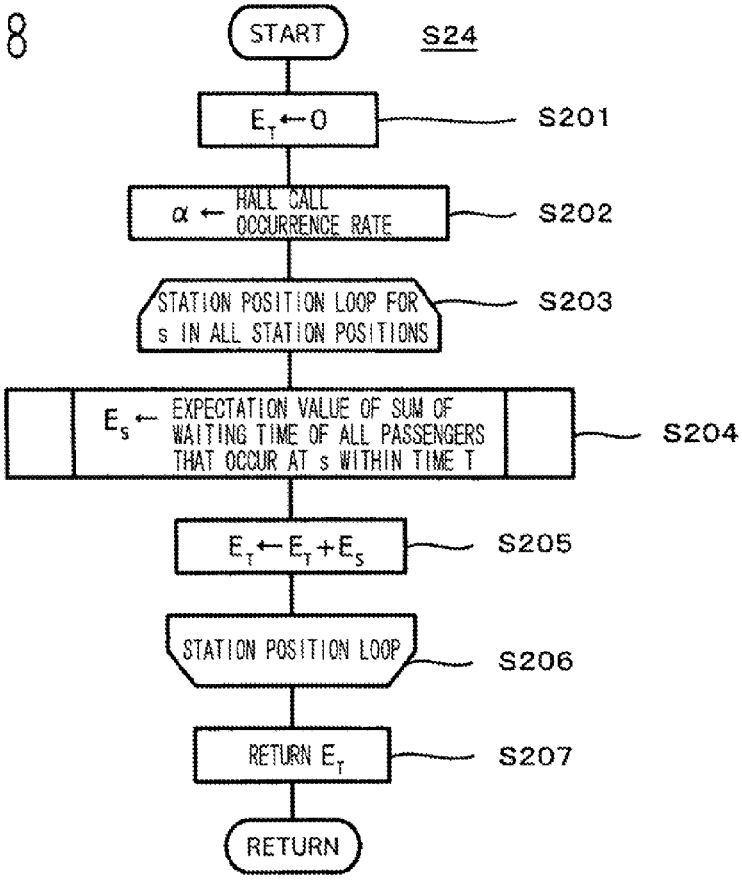
FIG. 8 is a flowchart explaining specific steps of the waiting time expectation value calculation process for all passengers at all station positions in Step S24 in FIG. 7.

Next, a specific procedure in Step S24 for calculating the waiting time expectation value of all the passengers at all the station positions, assuming that the new hall call is tentatively assigned to one car, is shown in the flowchart in FIG. 8.

First, in Step S201, the initial value of the variable $E_T$ representing the waiting time expectation value of all the passengers at all of the station positions is set to be 0. In Step S202, the hall call occurrence rate shown by equation 1 is obtained as $\alpha$, and based on Step S203 and Step S206, the process between these steps is repeated for all station positions. Specifically, in Step S204, the waiting time expectation value of all the passengers at the station position is calculated as $E_S$, and in Step S206, the value obtained by adding $E_S$ to $E_T$ is newly stored as $E_T$ by updating. In this manner, Step S204 and Step S205 are repeated for all of the station positions, and the waiting time expectation value of all the passengers at all the station positions, assuming that the new hall call is tentatively assigned to one car, is obtained as $E_T$. Then, in Step S207, the value of $E_T$ is returned to Step S24 in FIG. 7 and substituted for e.

Figure 9:
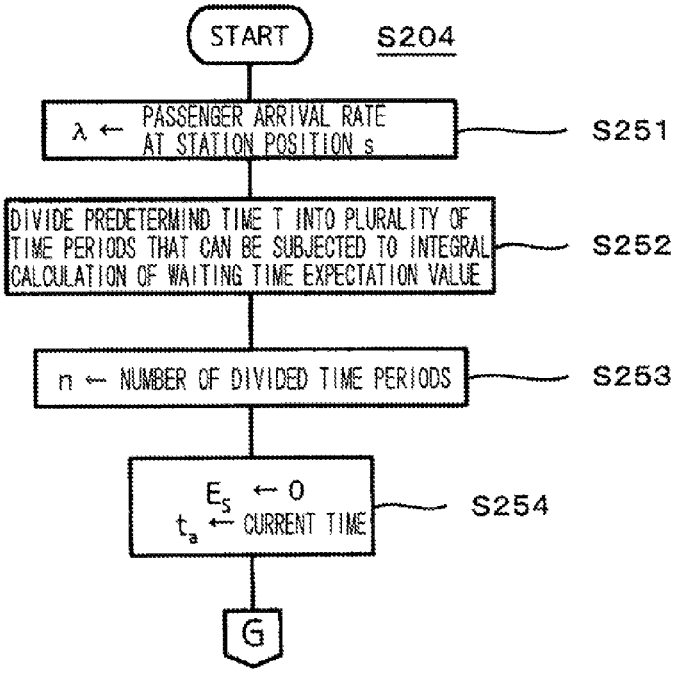
FIG. 9 is apart of a flowchart explaining specific steps of the waiting time expectation value calculation process for all passengers at a station position "s" in Step S204 in FIG. 8.
Figure 10:
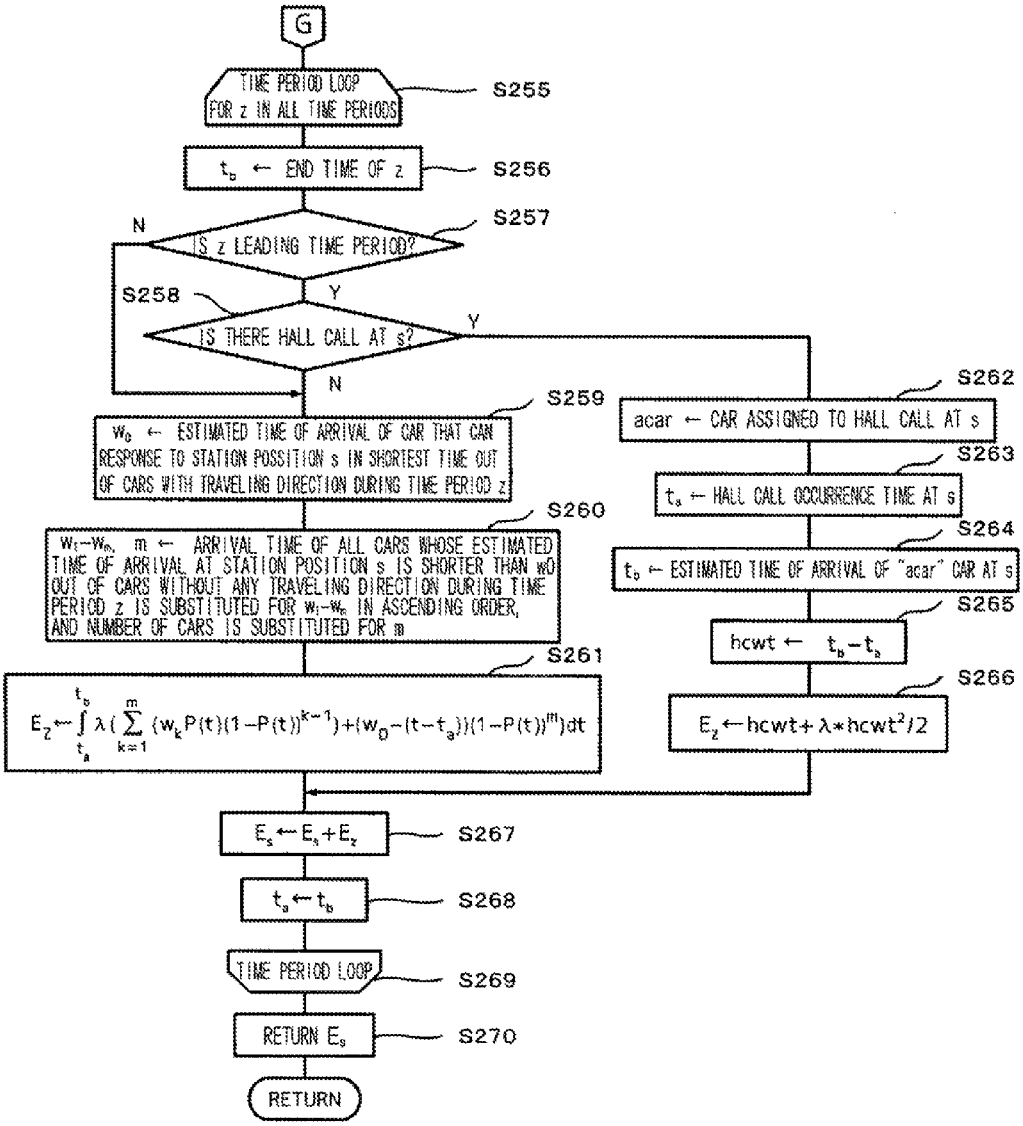
FIG. 10 is a part of the flowchart explaining specific steps of the waiting time expectation value calculation process for all passengers at a station positions in Step S204 in FIG. 8.

Next, a specific procedure in Step S204 for calculating the waiting time expectation value of all the passengers at one station position s is shown in flowcharts in FIG. 9 and FIG. 10. The procedure is divided into two flows at a connecting sign G for convenience sake.

First, in Step S251, a passenger arrival rate at the station position s is obtained as $\lambda$, and in Step S252, the predetermined time T (e.g., about 60 seconds) is divided into a plurality of time periods that can be subjected to the integral calculation of the waiting time expectation value, as described with reference to FIG. 5. In Step S253, a number of the divided time periods is taken as n, and in Step S254, the initial value of $E_S$ is set to be 0 and the initial value of $t_a$ is set to be the current time.

Then, based on Step S255 and Step S269, the process between these steps is repeated for all of the time periods. Specifically, in Step S256, the end time of a time period z is set to be $t_b$, and in Step S257, it is determined whether or not the time period z is a leading time period. If the time period z is the leading time period, then, in Step S258, it is determined whether or not there is a hall call at station position s. If there is no hall call at station position s, only the passengers that possibly appear within the predetermined time are considered, and the waiting time expectation value is calculated based on equation 3. Then, the process proceeds to Step S259.

In Step S259, the estimated time of arrival of a car that can arrive at the station position s in the shortest time out of all cars with a traveling direction during the time period z is substituted for $w_0$. In Step S260, arrival time of all cars whose estimated time of arrival at the station position s is shorter than w0 out of cars without any traveling direction during the time period z is substituted for $w_1$-$w_m$ in ascending order, and the number of the cars is substituted for m. Then, in Step S261, based on equation 3, the waiting time expectation value $E_Z$ during time period z is calculated.

On the other hand, if the time period z is the leading time period in Step S257, and if there is a hall call at the station position s in Step S258, the passengers that have already appeared are considered, and the waiting time expectation value is calculated based on equation 5. Then, the process proceeds to Step S262.

In Step S262, a car to which the hall call at the station position s is assigned is taken as "acar". Then, hall call occurrence time at the station position s is taken as $t_a$ in Step S263, estimated time of arrival of the "acar" carat the station position s is taken as $t_b$ in Step S264, estimated time of arrival hcwt is obtained based on the difference between $t_a$ and $t_b$ in Step S265, and the waiting time expectation value $E_Z$ is calculated during time period z based on equation 5 in Step S266.

Then, in Step S267, the value obtained by adding $E_Z$ obtained in Step S261 or Step S266 to the original value of $E_S$ is newly taken as $E_S$, and in Step S268, $t_b$ is newly stored as $t_a$ by updating. In this manner, the steps from Step S256 to Step S268 are repeated for all of the time periods, and the waiting time expectation value $E_S$ of all the passengers at the station position s is obtained. Then, in Step S270, the value of $E_S$ is returned to Step S204 in FIG. 8, and newly stored as $E_S$ by updating.

The above described is the new hall call assignment process taking the waiting time expectation value of all the passengers at all the station positions as the evaluation index.

Next, the hall call assignment change process that is performed every predetermined time is described similarly by taking the waiting time expectation value of all the passengers at all the station positions as the evaluation index.

Figure 11:
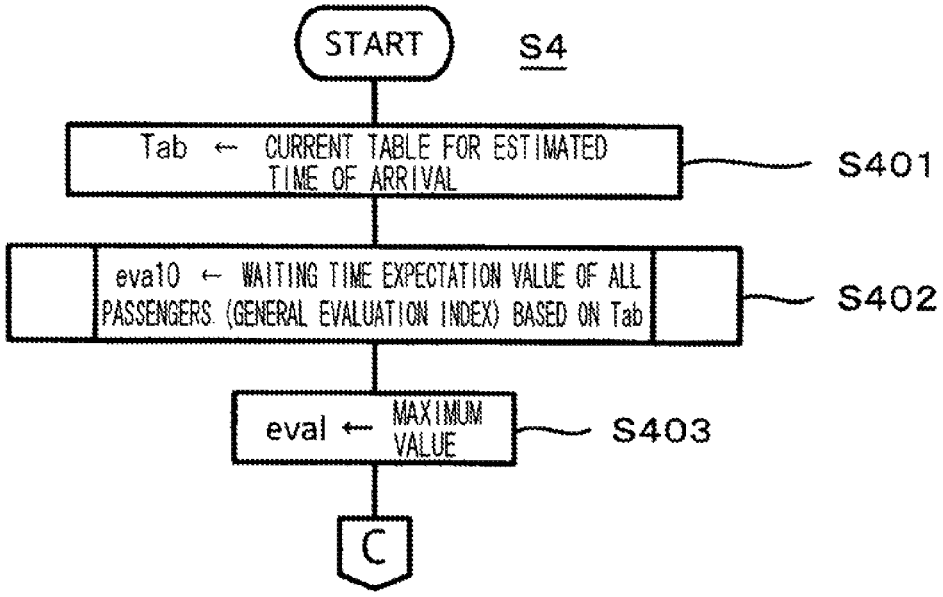
FIG. 11 is a part of a flowchart explaining specific steps of the hall call assignment change process in Step S4 in FIG. 4.
Figure 12:
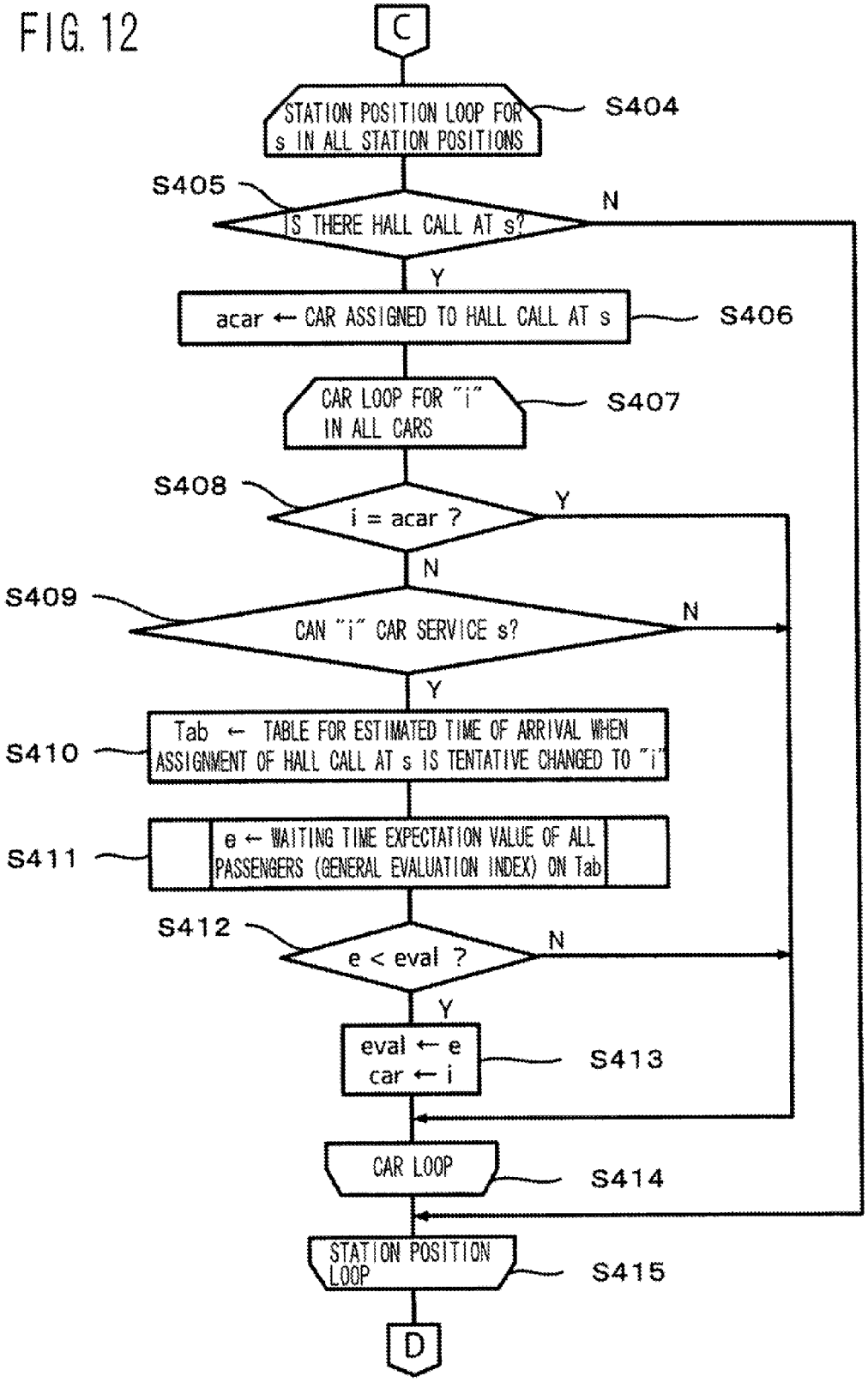
FIG. 12 is a part of the flowchart explaining specific steps of the hall call assignment change process in Step S4 in FIG. 4.
Figure 13:
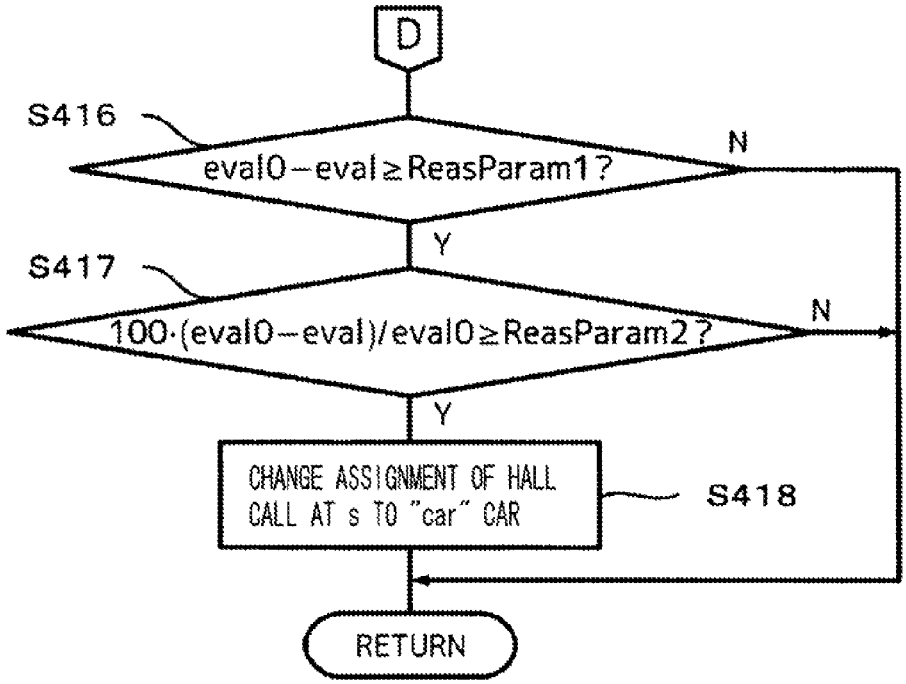
FIG. 13 is a part of the flowchart explaining specific steps of the hall call assignment change process in Step S4 in FIG. 4.

FIG. 11 through FIG. 13 are flowcharts explaining specific steps of the hall call assignment change process in Step S4 in FIG. 4. The process shown is divided into three flows at connecting signs C and D for convenience sake. In this process, the waiting time expectation value of all the passengers at all of the station positions, assuming that an assignment of a hall call that has been performed to one car, is changed to a different car is calculated, the calculated waiting time expectation value is compared with the waiting time expectation value before the assignment change, and the assignment change is performed if a difference between the two values satisfies a predetermined condition.

First, in Step S401, the current table for estimated time of arrival is generated for each car, and the generated tables are stored as Tab. In Step S402, the current waiting time expectation value of all the passengers at all the station positions is calculated based on the tables for estimated time of arrival, and stored as eval0. The calculation steps of the waiting time expectation value of all the passengers in Step S402 is the same as the process in Step S24 in FIG. 7 as described above, and therefore an explanation is omitted. In Step S403, the initial value of the variable eval representing the waiting time expectation value when the assignment change is performed is set to be the maximum value.

Then, based on Step S404 and Step S415, the process between these steps is repeated for all of the station positions. Specifically, in Step S405, it is determined whether or not there is an assigned hall call at the station position s. If there is an assigned hall call, the assigned car is taken as "acar" in Step S406.

Further, based on Step S407 and Step S414, the process between these steps is repeated for all of the cars from the first car. In Step S408, it is determined whether or not the "i" car is the "acar" car. If the "i" car is not the "acar" car, that is, not the car assigned for the station position s, it is determined whether or not the "i" car can service the station position s in Step S409. Then, if the "i" car can service, in Step S410, a table for the estimated time of arrival, assuming that the assigned car for the station position s is tentatively changed to the "i" car, is generated as shown in FIG. 3, and in Step S411, the waiting time expectation value of all the passengers is calculated based on the generated table for estimated time of arrival, and stored as variable e. The calculation steps of the waiting time expectation value of all the passengers in Step S411 is performed in the same manner as the process in Step S24 in FIG. 7 as described above, and therefore an explanation is omitted.

Then, in Step S412, the value of e and the value of eval are compared, and if e is smaller, e is newly stored as eval by updating, and the car number "i" of the assigned car at this time is stored as "car". Subsequently, the same process is repeated for all of the cars in Step S414, and then for all the station positions in Step S415, and the minimum value out of the waiting time expectation values, assuming that the assignment change is performed, is stored as eval, and the car to which the assignment is changed to this time is stored as "car".

Then, in Step S416, it is determined whether or not a difference between the current waiting time expectation value eval0 (before the tentative assignment change) and the minimum value eval after the tentative assignment change is greater than the set value ReasParam1. Further, in Step S417, it is determined whether or not the reduction rate of the waiting time expectation value (a value obtained by dividing the difference between the current waiting time expectation value eval0 and the minimum value eval after the tentative assignment change by eval0 and then multiplying by 100%) is no smaller than the set value ReasParam2. If the reduction rate is no smaller than the set value, in Step S418, the assignment of the hall call at the station position s is changed to the "car" car, and the hall call assignment change process is terminated. Specifically, in this example, in order to prevent unnecessary confusion due to the assignment change, the assignment change is performed only when the waiting time expectation value of all the passengers at all the station positions decreases by an amount of the set value or more and when the reduction rate is no smaller than the set value.

Next, a pseudo call assignment process that is performed every predetermined time is described similarly by taking the waiting time expectation value of all the passengers at all the station positions as the evaluation index.

Figure 14:
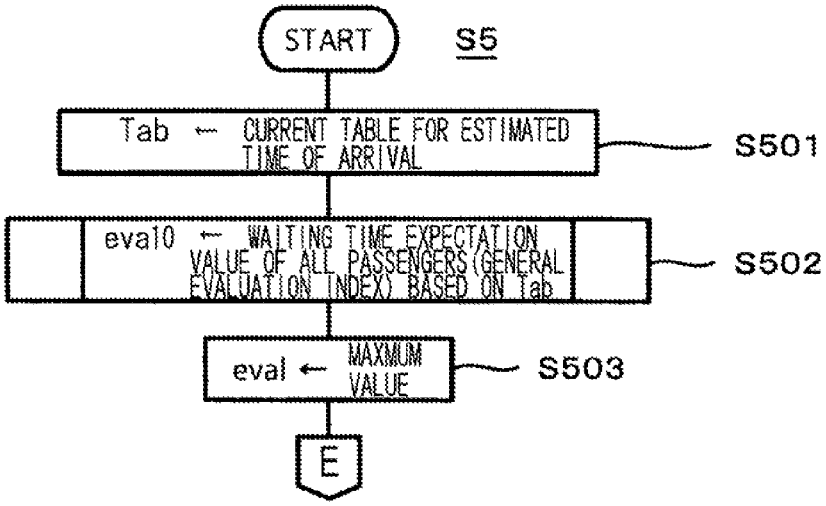
FIG. 14 is a part of a flowchart explaining specific steps of the pseudo call assignment process in Step S5 in FIG. 4.
Figure 15:
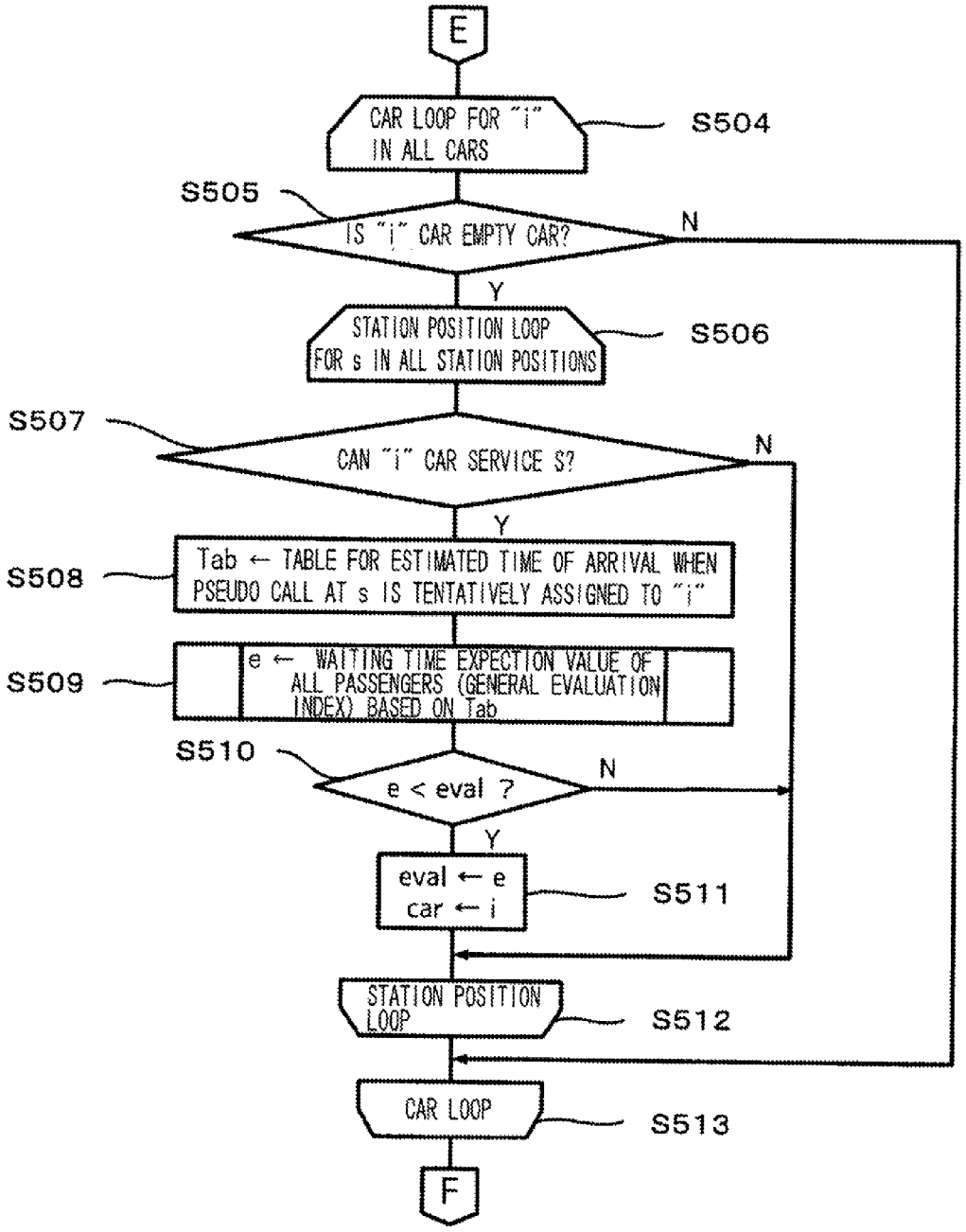
FIG. 15 is a part of the flowchart explaining specific steps of the pseudo call assignment process in Step S5 in FIG. 4.
Figure 16:
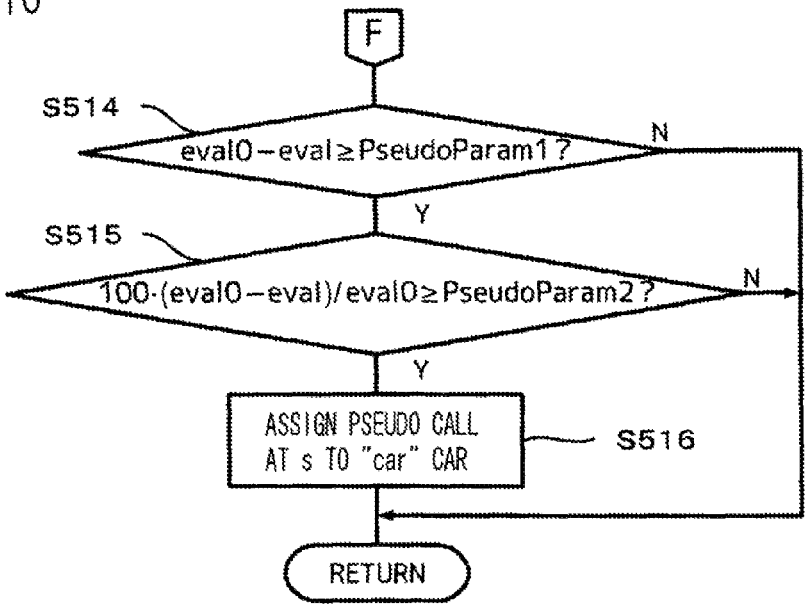
FIG. 16 is a part of the flowchart explaining specific steps of the pseudo call assignment process in Step S5 in FIG. 4.

FIG. 14 through FIG. 16 are flowcharts explaining specific steps of the pseudo call assignment process in Step S5 in FIG. 4. The process shown is divided into three flows at connecting signs E and F for convenience sake. In this process, the waiting time expectation value of all the passengers at all of the station positions assuming that a pseudo call at one station position is tentatively assigned to an empty car is calculated, the calculated waiting time expectation value is compared with the waiting time expectation value before the tentative assignment, and the pseudo call assignment is performed if a difference between the two values satisfies a predetermined condition.

First, in Step S501, the current table for estimated time of arrival is generated for each car, and the generated tables are stored as Tab. In Step S502, the current waiting time expectation value of all the passengers at all of the station positions is calculated based on the tables for estimated time of arrival, and stored as eval0. The calculation steps of the waiting time expectation value of all the passengers at all of the station positions in Step S502 are performed in the same manner as the process in Step S24 in FIG. 7 as described above, and therefore an explanation is omitted. In Step S503, the initial value of the variable eval is set to be the maximum value.

Then, based on Step S504 and Step S513, the process between these steps is repeated for all of the cars from the first car. Specifically, in Step S505, it is determined whether or not the "i" car is an empty car. If the "i" car is an empty car, based on Step S506 and Step S512, the process between these steps is repeated for all of the station positions s.

In Step S507, it is determined whether or not the "i" car can service the station positions. If the "i" car can service, in Step S508, a table for estimated time of arrival assuming that a pseudo call at the station position s is tentatively assigned to the "i" car is generated as shown in FIG. 3, and in Step S509, the waiting time expectation value of all the passengers is calculated based on the generated table for estimated time of arrival, and stored as the variable e. The calculation steps of the waiting time expectation value of all the passengers in Step S509 are performed in the same manner as the process in Step S24 in FIG. 7 as described above, and therefore an explanation is omitted.

Then, in Step S510, the value of e and the value of eval are compared, and if e is smaller, in Step S511, e is newly stored as eval by updating, and the car number "i" of the assigned car at this time is stored as "car" by updating. Subsequently, the same process is repeated for all of the station positions, and then for all of the cars, and the minimum value out of the waiting time expectation values assuming that the pseudo call assignment is performed is stored as eval, and the car to which the pseudo call is tentatively assigned is stored as "car".

Then, in Step S514, it is determined whether or not the difference between the current waiting time expectation value eval0 (before the tentative pseudo call assignment) and the minimum value eval after the tentative pseudo call assignment is greater than the set value PseudoParam1. Further, in Step S515, it is determined whether or not the reduction rate of the waiting time expectation value (a value obtained by dividing the difference between the current waiting time expectation value eval0 and the minimum value eval after the tentative pseudo call assignment by eval0 and then multiplying by 100%) is no smaller than the set value PseudoParam2. If the reduction rate is no smaller than the set value, in Step S516, the pseudo call at station position s is assigned to the "car" car, and the pseudo call assignment process to an empty car is terminated. Specifically, in this example, similarly to the case of the assignment change, in order to prevent unnecessary movement due to the pseudo call assignment, the pseudo call is assigned only when the waiting time expectation value of all the passengers decreases by the set value or more and the reduction rate is no smaller than the set value.

Second Embodiment

According to the first embodiment, the assignment of a new hall call is performed at a different timing from the assignment change of the hall call or the assignment of a pseudo call. However, the two processes can be performed at the same time.

Figure 17:
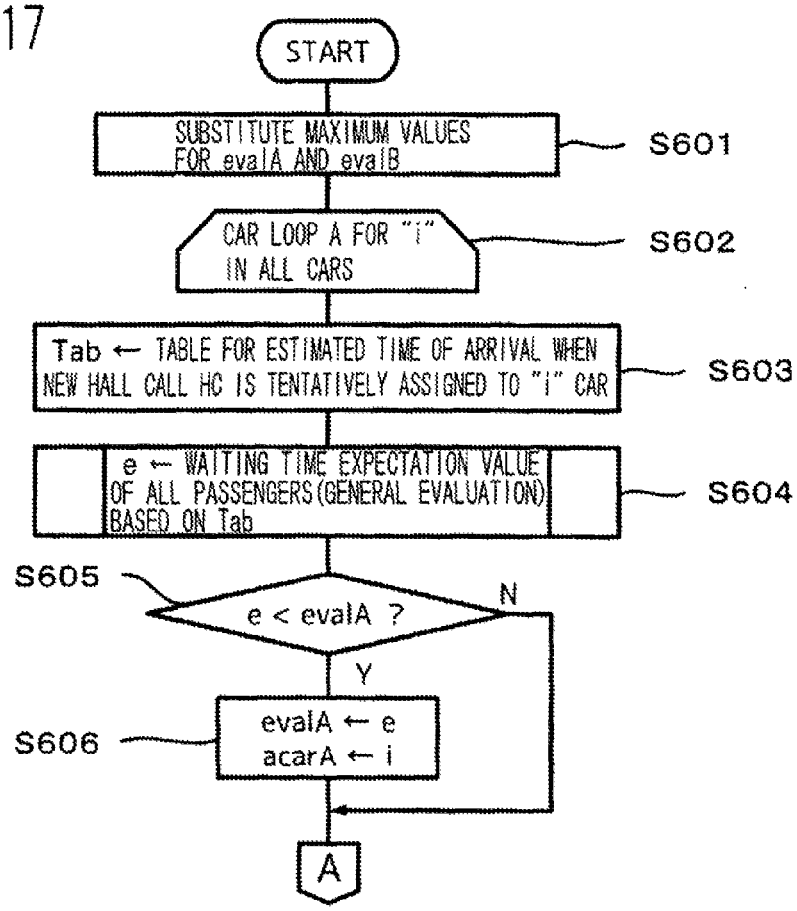
FIG. 17 is a part of a flowchart showing steps of a process of assigning a new hall call and changing the assignment according to a second embodiment of the present invention.
Figure 18:
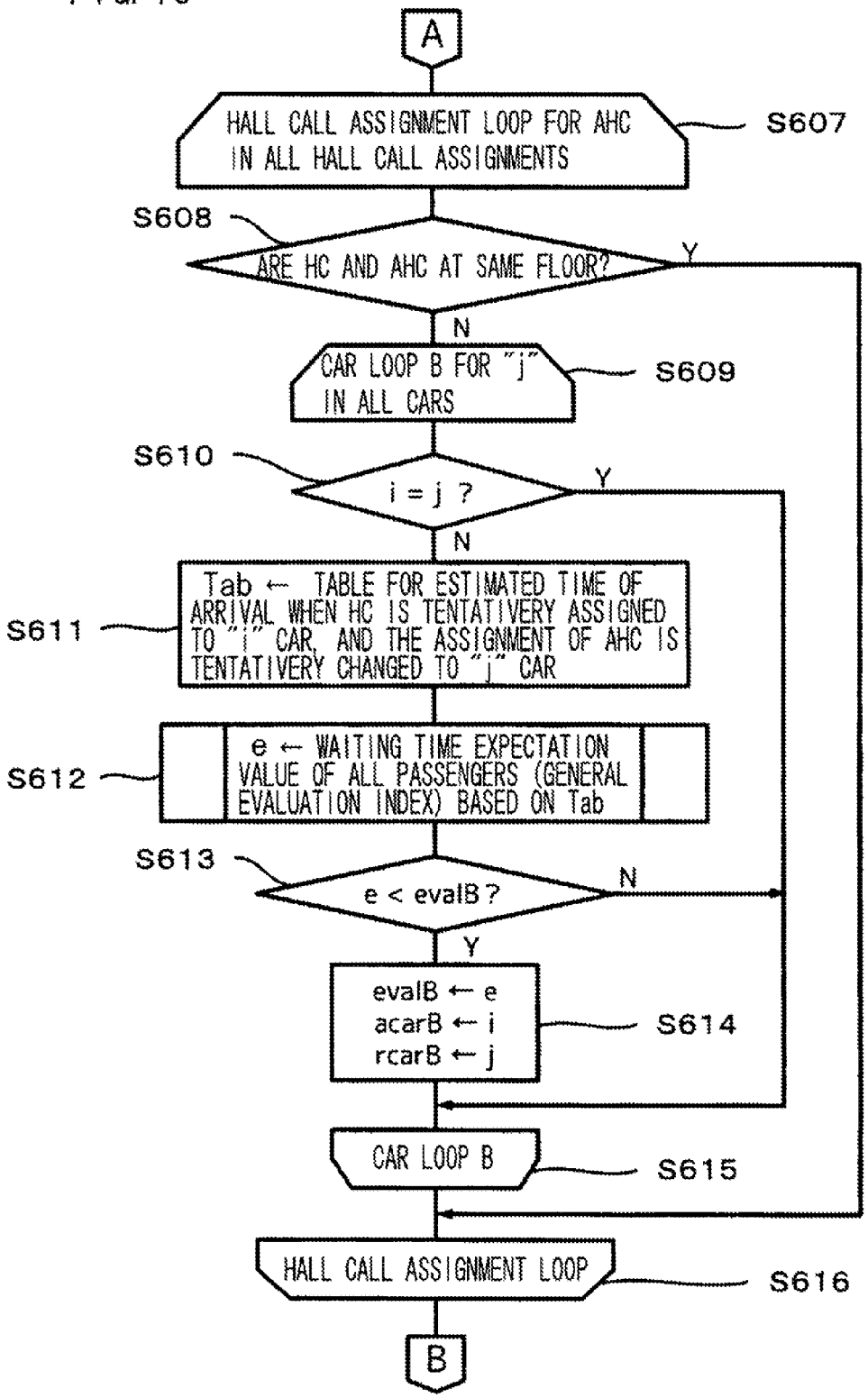
FIG. 18 is a part of the flowchart showing steps of the process of assigning a new hall call and changing the assignment according to the second embodiment of the present invention.
Figure 19:
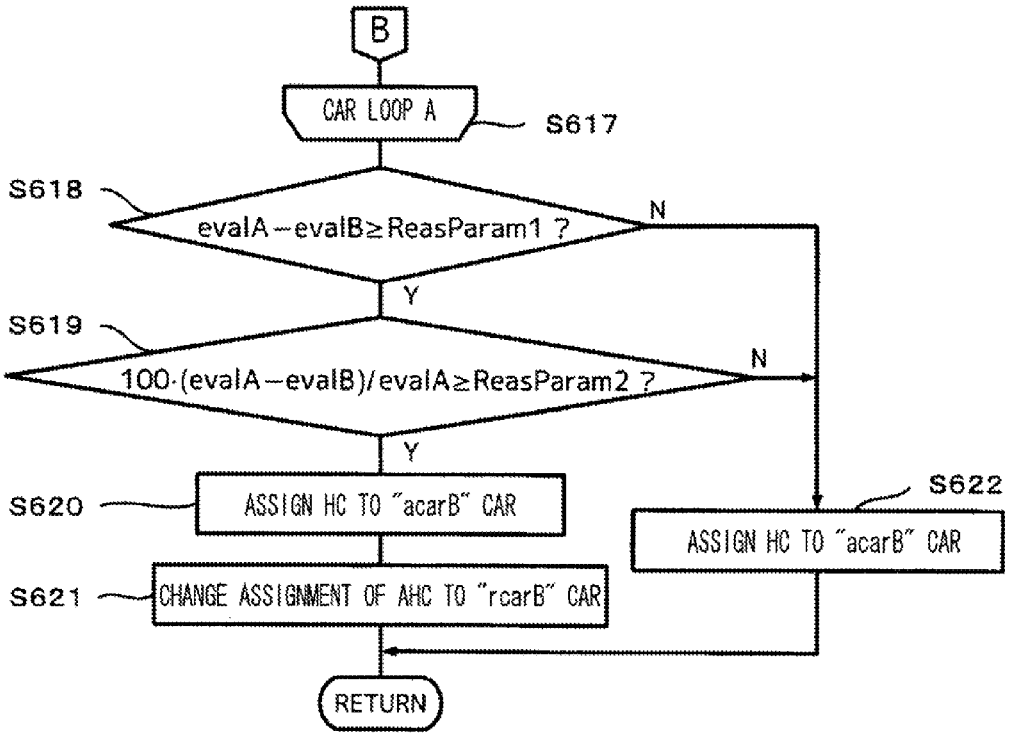
FIG. 19 is a part of the flowchart showing steps of the process of assigning a new hall call and changing the assignment according to the second embodiment of the present invention.

FIG. 17 through FIG. 19 are flowcharts showing a specific procedure for assigning a new hall call and changing an assignment of a hall call at the same time. The process shown is divided into three flows at connecting signs A and B for convenience sake.

This process is an example in which the waiting time expectation value of all the passengers at all of the station positions assuming that a new hall call is assigned to each car is compared with the waiting time expectation value of all the passengers at all of the station positions assuming that the assignment of an assigned hall call is changed to a different car at the same time, and the new hall call assignment and the assigned hall call assignment change are performed at the same time if a difference between the two values satisfies a predetermined condition. The process is performed when a new hall call is made.

First, in Step S601, a variable evalA representing the waiting time expectation value, assuming that a new hall call is tentatively assigned and a variable evalB representing the waiting time expectation value, assuming that the assignment change is performed at the same time with the tentative assignment of the new hall call, are respectively set to be maximum values, and based on Step S602 and Step S617, the process between these steps is repeated for all of the cars. Specifically, in Step S603, a table for estimated time of arrival assuming that a new hall call HC is tentatively assigned to an "i" car is generated, and then, in Step S604, the waiting time expectation value of all passengers at all station positions is calculated based on the generated table for estimated time of arrival, and set as a variable e. The calculation steps of the waiting time expectation value of all the passengers in Step S604 are performed in the same manner as the process in Step S24 in FIG. 7 as described above, and therefore an explanation is omitted.

Then, in Step S605, the value of e and the value of evalA are compared, and if e is smaller, in Step S606, e is newly stored as evalA by updating, and the car number "i" of the tentatively assigned car at this time is stored as "acarA" by updating.

Subsequently, based on Step S607 and Step S616, the process between these steps is repeated for all hall calls AHC that are assigned to the tentatively assigned car "i". Specifically, in Step S608, it is determined whether or not HC and AHC are calls made on the same floor, and if not med on the same floor, based on Step S609 and Step S615, the process between these steps is repeated for all cars "j". The reason why it is determined whether or not HC and AHC are calls for the same floor here is not to consider a hall call that is made on the same floor as a new hall call, but as a target of the assignment change when assigning the new hall call, because performing the assignment of a hall call and the assignment change on the same floor at the same time may confuse waiting passengers when a hall call in an opposite direction has already been registered on the floor on which the new hall call is made.

Then, in Step S610, it is determined whether or not $i=j$. If $i \neq j$, in Step S611, a table for the estimated time of arrival assuming that HC is tentatively assigned to the "i" car and the assignment of AHC is tentatively changed to the "j" car is generated. In Step S612, the waiting time expectation value of all the passengers at all station positions is calculated based on the table for estimated time of arrival, and the obtained value is set as the variable e. The calculation steps of the waiting time expectation value of all the passengers in Step S612 are performed in the same manner as the process in Step S24 in FIG. 7 as described above, and therefore an explanation is omitted.

In Step S613, the value of e and the value of evalB are compared, and if e is smaller, in Step S614, e is newly stored as evalB by updating, the tentatively assigned car "i" assigned to HC is stored as "acarB" by updating, and the car whose assignment is tentatively changed to AHC is stored as "rcarB" by updating. The tentatively assignment change is repeated for all the cars in Step S615, and for all of the hall calls AHC in Step S616, and the minimum value out of the waiting time expectation values assuming that the tentative assignment of the new hall call is performed at the same time as the tentative assignment change of the assigned hall call is stored as evalB, the tentatively assigned car at this time is stored as "acarB", and the car whose assignment is tentatively changed is stored as "rcarB".

Furthermore, this process is repeated for all the cars in Step S617, and the minimum value out of the waiting time expectation values assuming that the tentative assignment of the new hall call is performed is stored as evalA, and the tentatively assigned car at this time is stored as "acarA".

In Step S618, it is determined whether or not the difference between evalA and evalB is greater than the set value ReasParam1. Further, in Step S619, it is determined whether or not the reduction rate of the waiting time expectation value (a value obtained by dividing the difference between evalA and evalB by evalA, and then multiplying by 100%) is no smaller than the set value ReasParam2. If the reduction rate is no smaller than the set value, HC is assigned to the "acarB" car in Step S620, and the assignment of AHC is changed to the "rcarB" car in Step S621. Moreover, when even one of Step S618 and Step S619 is not satisfied, HC is assigned to the "acarA" car in Step S622, and the assignment of the assigned hall call is not changed. Specifically, in this example, in order to prevent unnecessary confusion due to the assignment change, the assignment of a new hall call and the assignment change are performed at the same time only when the waiting time expectation value of all passengers at all of the station positions decreases by the amount of the set value or more and when the reduction rate is no smaller than the set value, and only the assignment of a new hall call is performed when not.

While, in this example, the case in which the assignment change is performed at the same time with the assignment of a new hall call is described, it is also possible to perform the assignment of a pseudo call to an empty car at the same time with the assignment of a new hall call, instead of or along with the hall call assignment change.

Other Embodiments

It should be appreciated that, while in the above embodiments, the difference and the reduction rate from the current waiting time expectation value is compared with a set value as criteria for performing the hall call assignment change and the assignment of a pseudo call, such set value is not required to be a fixed value. The value can be set to be any value according to the group management specifications and conditions of the building; for example, the set value regarding the assignment change can be set to be closer to 0 when the immediate prediction is not performed, and the hall call assignment change is performed if there is possibility of improvement in the waiting time expectation value if only a little, or the set value regarding the pseudo call assignment can be set to be a greater value when energy saving is considered to be important, and standby operation using a pseudo call is performed only in a situation in which it is expected to reduce the waiting time to a large extent.

Further, in the above embodiments, as the waiting time expectation value of all passengers at all the station positions is taken as the general evaluation index, it is not necessarily possible to assign a car that can arrive in the shortest time to individual hall calls, and there is a case in which the car can pass without responding to a hall call. In such a case, if the group management system is provided with only a hall lantern as a guiding device in the elevator hall, then there is no problem as waiting passengers cannot see whether or not a car passes by without responding to the hall call. However, in the case that the group management system is provided with a hall indicator indicating the floor at which the car is currently in as the guiding device in an elevator hall, the waiting passengers at the elevator hall can see the car passing without responding to the hall call. Further, a car passing without responding to the hall call can also be recognized in the case in which doors at the hall has a window. Therefore, in a group management system of such specifications, there is a problem where the waiting passengers seeing the car passing without responding to the hall call may feel that their requests are unduly ignored or that the passengers are given a low priority, and thus dissatisfy with the group management system.

In order to address such a problem, it is possible to provide means for converting the car passing without responding to the hall call (including changing the direction of an approaching car) contrary to the expectation of the waiting passenger as a penalty value into waiting time.

For example, where the time of passage of the car is $t_p$ and the time at which the hall call is serviced by the car is $t_s$, the penalty value can be calculated by equation 7 listed below.

$$\text{Penalty Value}=A+B(t_s-t_p) \quad \text{[Equation 7]}$$

Here, A is an invariable for converting customers' dissatisfaction with passage of the car into time, and B is a coefficient representing dissatisfaction of the customers that increases in proportion to the time elapsed after the passage. Further, $t_s$ and $t_p$ can be obtained in the table for estimated time of arrival described above.

In the case in which the waiting passengers can recognize the passage of the car due to installation of the hall indicator or such, the evaluation can be made by adding the penalty value to the waiting time expectation value of all the passengers as the general evaluation index according to the present invention, or comprehensive evaluation can be performed by further adding other evaluation indices.

In addition, the present invention is not limited to the above embodiments, and various modifications can be made without departing the spirit of the present invention.

REFERENCE MARKS IN THE DRAWINGS

11-13 Elevator Control Device
20 Hall Call Registration Device
30 Group Control Device
31 Passenger Arrival Rate Estimating Means
32 Hall Call Occurrence Rate Estimating Means
33 Car Arrival Time Estimating Means
34 Waiting Time Expectation Value Calculating Means
35 Hall Call Assigning Means
36 Hall Call Assignment Changing Means
37 Pseudo Call Assigning Means
38 Learning Means
39 Communicating Means

The invention claimed is:

1. An elevator group control method, comprising:

placing a plurality of elevators in service for a plurality of floors;

calculating an evaluation index for a newly made hall call; and selecting and assigning the best suited car to the hall call based on the evaluation index, wherein a waiting time expectation value of all passengers on all floors for each direction, including passengers that have already appeared and passengers that are expected to appear at all station positions within a predetermined time period, is taken as the evaluation index, the waiting time expectation value being the expectation value for the sum or the average of the waiting time.

2. The elevator group control method according to claim 1, wherein every predetermined time, the waiting time expectation value assuming that an assignment change of a hall call that has already been assigned is performed, is calculated, and the assignment change is performed if a difference between the calculated waiting time expectation value and the waiting time expectation value, before the assignment change, satisfies a predetermined condition.

3. The elevator group control method according to claim 1, wherein every time a new hall call is made, the waiting time expectation value, assuming that the new hall call is assigned, and the waiting time expectation value, assuming that an assignment change of a hall call is performed at the same time with the assignment of the new hall, are calculated, and the assignment change of the hall call is performed at the same time with the assignment of the new hall call if the difference between the two waiting time expectation values satisfies a predetermined condition.

4. The elevator group control method according to claim 1, wherein every predetermined time, the waiting time expectation value, assuming that a pseudo call is tentatively assigned to an empty car, is calculated, and the assignment of the pseudo call is performed if the difference between the calculated waiting time expectation value and the waiting time expectation value before the tentative assignment satisfies a predetermined condition.

5. The elevator group control method according to claim 1, wherein every time when a new hall call is made, the waiting time expectation value, assuming that the new hall call is assigned, and the waiting time expectation value, assuming that a pseudo call is tentatively assigned to an empty car at the same time with the assignment of the new hall call, are calculated, and the assignment of the pseudo call is performed at the same time with the assignment of the new hall call if the difference between the two waiting time expectation values satisfies a predetermined condition.

6. The elevator group control method according to claim 2, wherein the predetermined condition is adjustable.

7. The elevator group control method according to claim 1, wherein the waiting time expectation value is calculated using an estimated value of a passenger arrival rate on each floor and for each direction, an estimated value of a hall call occurrence rate of an entire group, and the estimated time of arrival of each car, for each floor and in each direction.

8. An elevator group control device capable of placing a plurality of elevators in service for a plurality of floors, calculating an evaluation index for a newly made hall call, and selecting and assigning the best suited car to the hall call based on the evaluation index, the device comprising:

waiting time expectation value calculating means configured to calculate a waiting time expectation value of all passengers on all floors for each direction, including passengers that have already appeared and passengers that are expected to appear at all station positions within a predetermined time period; and hall call assigning means configured to assign the new hall call based on the waiting time expectation value.

9. An elevator group control device capable of placing a plurality of elevators in service for a plurality of floors, calculating an evaluation index for a newly made hall call, and selecting and assigning the best suited car to the hall call based on the evaluation index, the device comprising:

waiting time expectation value calculating means configured to calculate a waiting time expectation value of all passengers on all floors for each direction, including passengers that have already appeared and passengers that are expected to appear at all station positions within a predetermined time period;

hall call assigning means configured to assign the new hall call based on the waiting time expectation value;

hall call assignment changing means configured to perform an assignment change of a hall call based on the waiting time expectation value; and pseudo call assigning means configured to assign a pseudo call to an empty car based on the waiting time expectation value.

* * * * *